United States Patent [19]

Gerry

[11] Patent Number: 4,537,175

[45] Date of Patent: Aug. 27, 1985

[54] BIPOLAR MAGNETIC PULSE ACTIVATED IGNITION SYSTEM

[76] Inventor: Martin E. Gerry, 13452 Winthrope St., Santa Ana, Calif. 92705

[21] Appl. No.: 676,514

[22] Filed: Nov. 29, 1984

[51] Int. Cl.[3] ..... F02P 1/00

[52] U.S. Cl. ..... 123/649; 123/651; 123/617

[58] Field of Search ..... 123/617, 649, 651, 414

[56] References Cited

U.S. PATENT DOCUMENTS

| | | | |
|---|---|---|---|
| 3,167,705 | 1/1965 | Sohner | 123/649 |
| 3,253,168 | 5/1966 | Robbins | 123/617 |
| 3,308,341 | 3/1967 | McLaughlin | 123/617 |
| 4,377,151 | 3/1983 | Gerry | 123/651 |

FOREIGN PATENT DOCUMENTS

| | | | |
|---|---|---|---|
| 956499 | 4/1964 | United Kingdom | 123/649 |

*Primary Examiner*—Ronald B. Cox

[57] ABSTRACT

An ignition system for a fuel burning engine has a transformer with a primary winding (L1) and a secondary winding (L2). A magnetic pulse time (20) provides a bipolar signal to the input circuits of a pair of transistors (Qa-Qb, Qn-Qp, Q2-Q3, Q4-Q5, Q6a-Q7) of opposite conductivities. The output circuits of such transistor pair are serially connected and also connected in series with ignition transformer primary winding. The transistor pair is simultaneously activated to provide current flow in the primary winding and simultaneously deactivated to discontinue such current flow to create an induced voltage in the primary winding that is transferred to the secondary winding to fire igniters of the engine. Transistor pairs of the multijunction, unijunction and field effect Darlington or non-Darlington types may be utilized.

21 Claims, 19 Drawing Figures

BIPOLAR MAGNETIC PULSE ACTIVATED IGNITION SYSTEM

TECHNICAL FIELD

This invention is in the field of electronic ignition systems utilizing magnetic pulse timers.

BACKGROUND ART

A magnetic pulse timer coupled to a semiconductor switch is utilized to activate a power transistor that is connected to an ignition transformer primary winding. Such prior art circuitry is usually dependent upon variations in voltage levels of a DC power source.

An ignition circuit with an improved bipolar activated timer is shown in U.S. Pat. No. 4,377,151 to same applicant. The circuit therein likewise makes use of a timer and its bipolar semiconductor circuit to drive a power transistor connected to the ignition transformer primary winding to activate and deactivate such single power transistor.

DISCLOSURE OF INVENTION

The invention utilizes a pair of transistors of opposite conductivities with their output circuits serially connected. One transistor collector has DC power applied thereto while the other transistor collector is connected to the primary winding of the ignition transformer. The bases of these transistors are directly coupled to the terminals of the output winding of the timer's coil, providing a bipolar pulse output to these transistors to activate and deactivate such transistors directly and without any intermediate semiconductor stages between such transistors and timer output winding. Such circuit enjoys the benefit of developing approximately double the voltage induced into the primary winding of the ignition transformer as compared to single power transistor controlling primary winding current flow. The increased induced primary voltage also approximately doubles the secondary voltage and ignition energy.

BEST MODE FOR CARRYING OUT THE INVENTION

Figure 1:
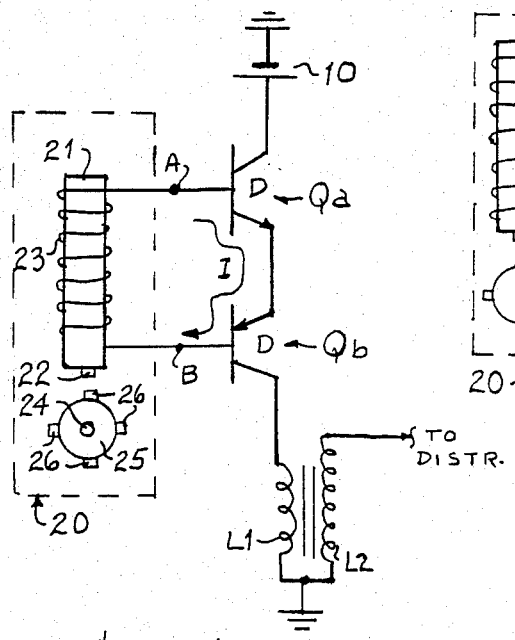
FIG. 1 is an electrical schematic of a circuit utilizing a Darlington transistor pair in accordance with the invention.
Figure 5:
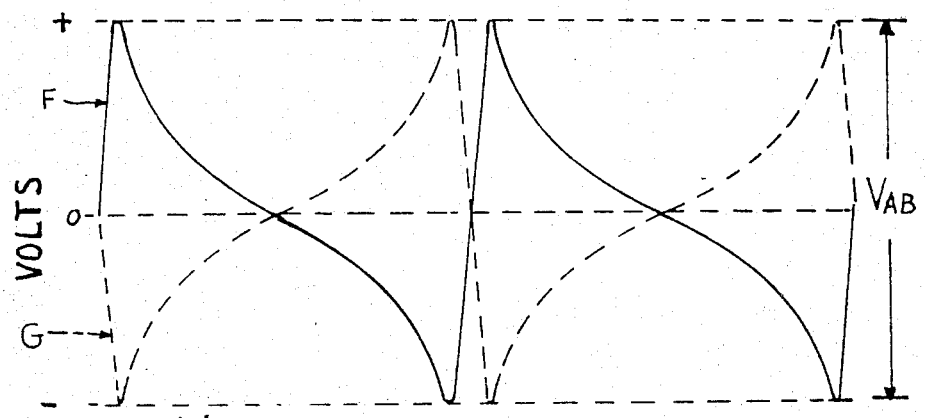
FIGS. 5 and 6 are waveforms of voltages present between the bases of the transistors of FIG. 1 and between the base and emitter of each transistor.
Figure 6:
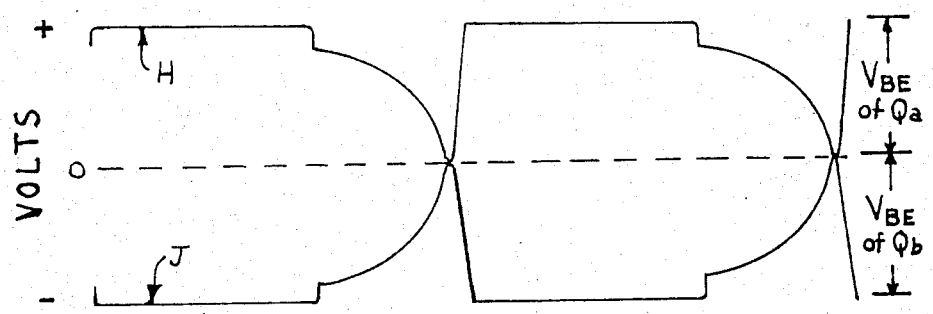

Referring to FIGS. 1, 5 and 6, an ignition system is illustrated utilizing a conventional magnetic pulse timer 20, operating in conjunction with a pair of Darlington type transistors Qa and Qb, designated by the symbol D in the transistor illustrations. The output circuits of such transistors of the NPN and PNP types are serially connected by connecting their emitters in series. A DC power source 10, the negative terminal of the power source being at ground potential, has its positive terminal connected to the collector of transistor Qa, the collector of transistor Qb being connected to one side of primary winding L1 of an ignition transformer, the other side of the primary winding and one side of secondary winding L2 being commonly at ground potential, whereas the other side of secondary winding L2 is fed to a rotor member of a high voltage conventional distributor, not shown herein, such distributor being one that feeds four igniters inasmuch as reluctor wheel 25 of timer 20 is designated for a four igniter operation. Such reluctor wheel and distributor rotor are electrically insulated from each other and are mounted on and driven by the same distributor shaft 24.

Reluctor wheel 25 therefore has four protrusions 26 regularly spaced from each other at the wheel's outer preiphery. Each time one of protrusions 26 passes armature pole piece 22 of a permanently magnetized core 21, a bipolar pair of pulses is generated at outputs A and B of coil 23, coil 23 being wound on core 21.

The operation of timer 20 as it relates to the circuits of FIGS. 1, 2, 3, 4, 11, 18 and 19, is provided in detail in U.S. Pat. No. 4,377,151 issued to same applicant, but a summary of such operation is provided herein.

When reluctor wheel 25 is at standstill, or when lead A is at negative potential provided by coil 23, lead B will be at positive potential, and no current I will flow. When lead A is at positive potential and B at negative potential, current I will flow in both the base of Qa and the base of Qb turning on both Qa and Qb, energizing primary winding L1 with current supplied by DC power source 10 and charging L1. When waveform F is at the output of the leads A and B, a positive potential pulse is provided at A and a negative potential is exhibited at B due to rotation of reluctor wheel 25 to cause protrusion 26 to pass pole piece 22, causing Qa and Qb to conduct. Conduction of current through the collector-emitter circuits of Qa and Qb will continue to energize primary winding L1 until the next negative pulse output of the bipolar pulse pair from coil 23 will occur.

Such next negative pulse is spaced a substantial distance from its preceding positive going pulse due to spacing between protrusions, thus affording primary winding L1 a sufficient time to develop a large charge and thereby enable it to release such charge or magnetic flux upon arrival of such next negative pulse to induce a voltage in primary winding L1 for transfer to secondary winding L2 by magnetic coupling between L1 and L2.

Waveform F output therefore is characterized by a pair of bipolar pulses spaced to each other wherein the negative pulse leads the positive pulse in time frame. On the other hand, waveform G, obtained by transposing leads A and B, so that lead B is connected to the base of Qa and lead A is connected to the base of Qb, will provide a leading positive pulse of the bipolar pulse pair output of coil 23.

Figure 4:
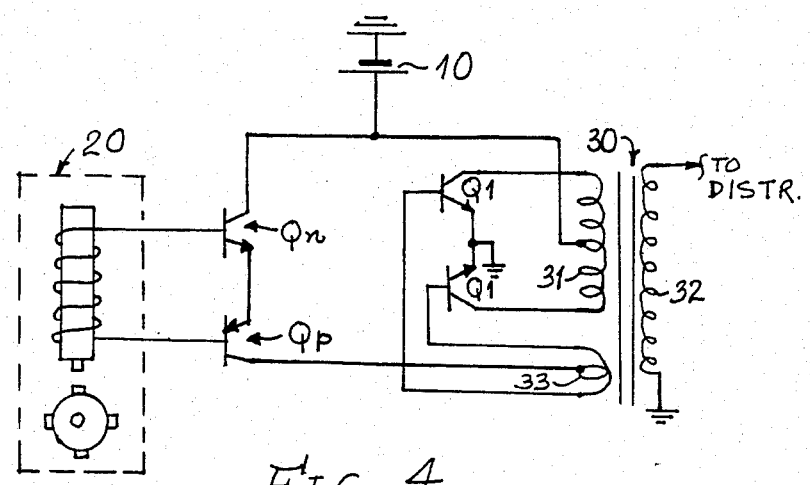
FIG. 4 is an electrical schematic showing the circuit of FIG. 1 activating an AC generator.

Circuits requiring the charging of an inductor to obtain an induced voltage therein on discharge action require waveform F condition. Circuits requiring switching of power generated by an AC generator, such as shown in FIG. 4, require waveform G condition, and hence leads A and B are connected accordingly.

Hence, it can be appreciated that one pulse of the bipolar pulse pair will be obtained when the leading edge of protrusion 26 passes the leading edge of pole piece 22, and the other pulse of such pair will be obtained when the lagging edge of protrusion 26 passes the lagging edge of pole piece 22.

With respect to any of the configurations illustrated, an advantage is gained utilizing the circuits of Qa and Qb in that trigger actuation of such circuits by generation of either waveform F or G as input to Qa and Qb makes switching initiation independent of the DC power source 10 and consequently independent of its voltage and current variations.

The benefit of bipolar operation by activating and deactivating Qa and Qb simultaneously may be appreciated by examining their emitter-base voltages $V_{BE}$ illustrated as waveforms H and J in FIG. 6. During conduction of Qa the base to emitter voltage $V_{BE}$ will drop from a positive voltage level to zero level, whereas the base to emitter voltage $V_{BE}$ of Qb will rise from a negative voltage level to zero level, thereby resulting in a base to base voltage which is double the base to emitter voltage of either Qa or Qb alone. Qa and Qb will simultaneously switch from their OFF to their ON states to permit charging of primary L1 rapidly. Discharge of charged primary L1 will occur when the next negative pulse of the bipolar pulse pair is applied at lead A, causing lead B to be of positive polarity and simultaneously causing current I to go to zero level, turning off Qa and Qb simultaneously.

Although Qa and Qb have been illustrated as Darlington type multijunction transistors, such transistors may be of the power type, may be of the unijunction or field effect Darlington or non-Darlington types.

Figure 2:
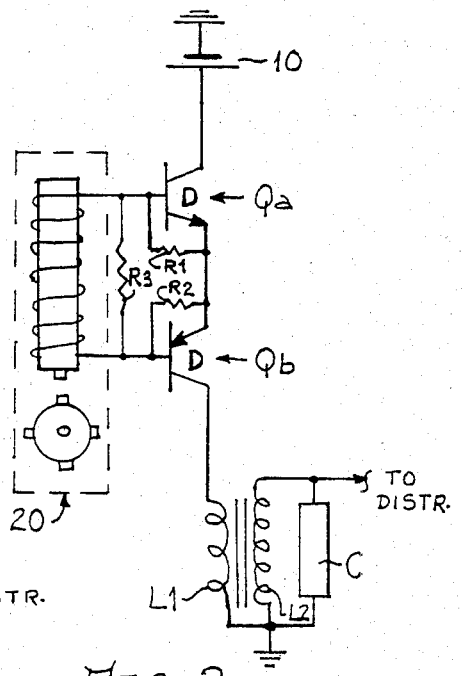
FIG. 2 is an electrical schematic of the circuit of FIG. 1 including means for biasing the transistors to reduce the voltage output from the secondary winding of the ignition transformer.

Referring to FIG. 2, the same operational criteria applies as discussed in conjunction with FIG. 1 configuration. A capacitor C is shown shunting secondary winding L2 of the ignition transformer. Such capacitor is of the distributed parameter type as illustrated in U.S. Pat. Nos. 4,413,304 or 4,422,054 to same applicant. It had been found that such capacitor increases the voltage and current output of L2 dramatically. In order to decrease such voltage L2 outputs, transistors Qa and Qb may be conveniently biased by utilizing resistors R1, R2 and/or R3 connected between the emitter and base of one or both Qa and Qb, or by connecting resistor R3 between the bases of Qa and Qb.

The following tables indicate test results of the utilization of resistors R1, R2 and/or R3, wherein transistor Qa was of the TIP 142 Darlington type and transistor Qb was of the TIP 147 Darlington type made by Motorola Semiconductor Products, Inc.

Qa BIAS

| R1 in ohms | Base to Emitter Voltage in volts | Relative Voltage Output Level of L2 |
|---|---|---|
| Infinite | −0.16 | Maximum |
| 2400 | +0.18 | Intermediate |
| 1300 | +0.27 | Low |

Qb BIAS

| R2 in ohms | Base to Emitter Voltage in volts | Relative Voltage Output Level of L2 |
|---|---|---|
| Infinite | −0.15 | Maximum |
| 2400 | −0.27 | Intermediate |
| 1300 | −0.27 | Low |

Qa - Qb BIAS

| R3 in ohms | Base to Emitter of Qa in volts | Base to Emitter of Qb in volts | Relative Voltage Output Level of L2 |
|---|---|---|---|
| 4600 | −0.12 | +0.06 | Maximum |
| 2300 | −0.06 | +0.06 | Intermediate |
| 1300 | −0.01 | +0.025 | Low |

Figure 3:
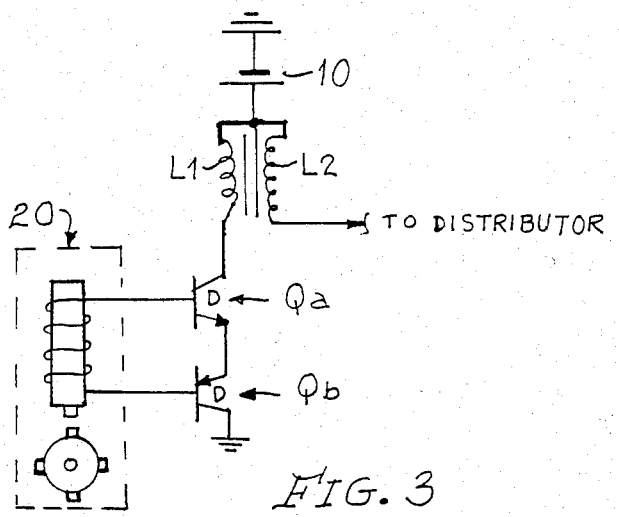
FIG. 3 is a circuit similar to that of FIG. 1 except that the primary winding of the ignition transformer is located in a different collector circuit from that illustrated in FIG. 1.

Referring to FIG. 3, the circuit therein is the same as the one in FIG. 1, except that the primary winding L1 is in the collector circuit of transistor Qa and is powered by DC source 10 applying a positive voltage to the junction of winding L1 and L2, and the collector of Qb is at ground potential. Otherwise the operation of this circuit is identical to the operation discussed for FIG. 1 configuration. One detriment of this circuit is that one end of secondary winding L2 is connected to DC power source 10 and hence requires a capacitor between the junction of L1 and L2 and ground in order to provide a shortened electrical path for ignition current flow and to prevent ignition energy loss due to long leads connecting source 10 to the ignition transformer.

Referring to FIGS. 4 and 5, timer 20 is the same as described in conjunction with FIG. 1 description, except that transistors Qn and Qp therein may be of non-Darlington transistors, or Darlington types if desired. Output leads from the coil of timer 20 are connected to bases of Qn and Qp respectively. Transistor Qn is of the NPN type and transistor Qp is of the PNP type. Transistor Qn has its collector connected to the positive terminal of DC source 10, the collector of transistor Qp being connected to a center tap at 33 of a tertiary or feedback winding made part of ignition transformer 30. Ignition transformer 30 has a center tapped primary winding 31, the ends of which are connected to the collectors of a pair of NPN transistors Q1, their emitters being at ground potential. The center tap of winding 31 is connected to the positive terminal of DC source 10. The circuit consisting of windings 31 and 33 and transistors Q1 is an alternating current square wave generator of the Royer type providing the AC rectangular waveform each time the center tap at 33 is biased positively for enabling conduction of transistors Q1, and well known in the art.

This generator is triggered by activation of transistors Qn and Qp utilizing waveform G of FIG. 5 principle. Activation of transistors Qn–Qp causes a positive DC voltage level to be applied to tap 33 turning on transistors Q1 in sequence to create oscillation of the Royer generator circuit. Secondary winding 32, analogous to secondary winding L2 of FIG. 1, provides the output of the AC generated power to a high voltage distributor. The negative pulse of the bipolar pulse pair arriving at the base of Qn, causes the base of Qp to be positive, turning off Qn and Qp simultaneously and providing zero bias to tap 33 causing transistors Q1 to be turned off and producing zero voltage across the output of winding 32.

The following listing shows transistors in small type TO-220AB plastic packages usable in the foregoing circuits to enable the total ignition electronics to be manufactured in a container small enough to be included within the confines of the ignition distributor per se:

| NPN Type | PNP Type | Usable As |
|---|---|---|
| 2N6388 | 2N6668 | Qa, Qb |
| TIP 142 Motorola | TIP 147 Motorola | Qa, Qb |
| SE 9302 Motorola | SE 9402 Motorola | Qa, Qb |
| D44H11 | D45H11 | Qn, Qp |
| 2N6488 | 2N6491 | Qn, Qp |
| MJE 13007 Motorola | MJE 5852 Motorola | Qn, Qp |

It should be noted that the collector to emitter circuits of transistors Qa and Qb exhibit capacitive output parameters which aid in producing an increased voltage and current in the primary winding L1. Transistors Qn and Qp also have such inherent output capacities, as well as transistors Q2 through Q7 inclusive.

Figure 7:
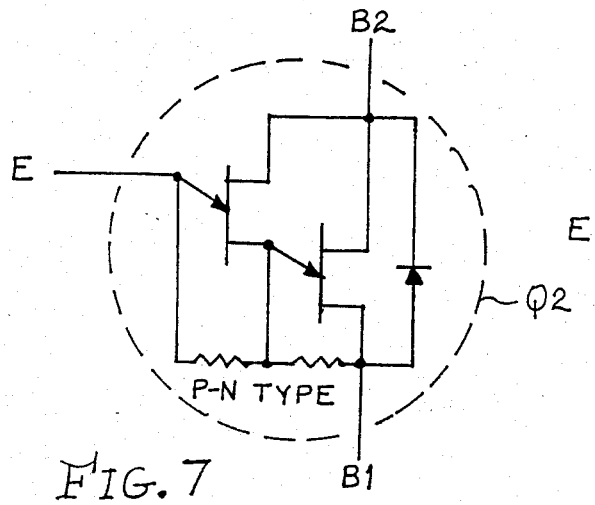
FIGS. 7, 8, 9 and 10 are representative P-N and N-P unijunction type Darlington transistors utilized in the circuit of FIG. 11, which is analogous to FIG. 1 circuit.
Figure 8:
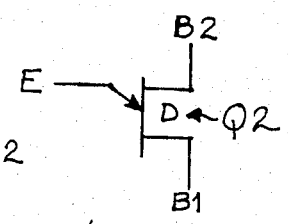
Figure 9:
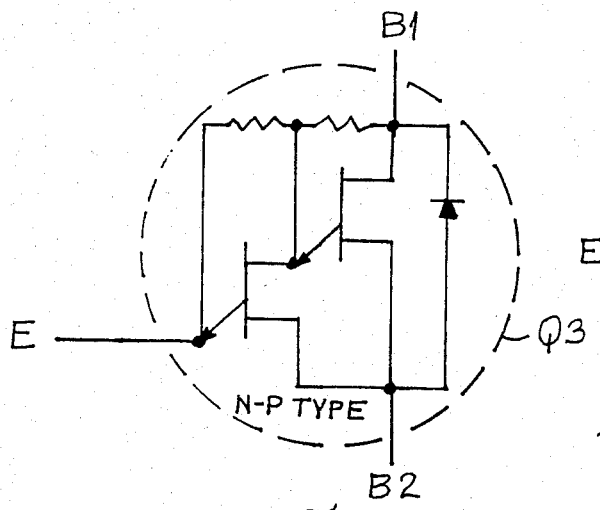
Figure 10:
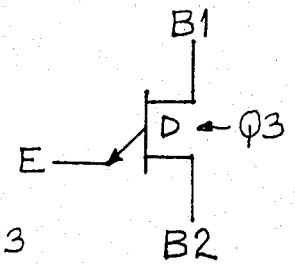
Figure 11:
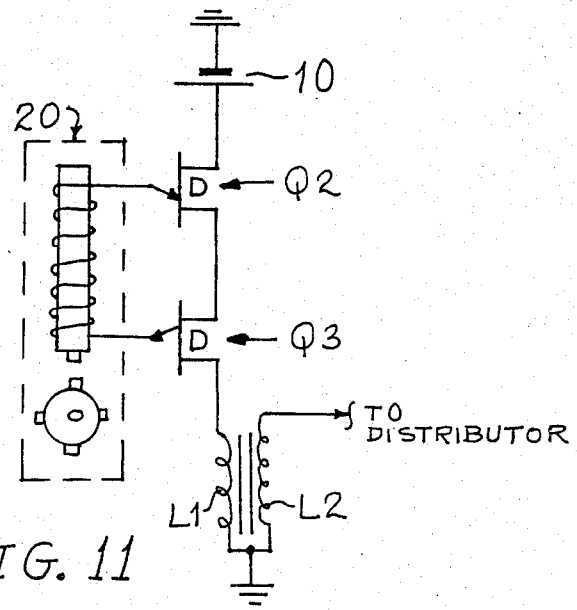

Referring to FIGS. 7, 8, 9, 10 and 11, unijunction transistor circuitry of Q2 and Q3 may be utilized with magnetic pulse timer 20 in similar manner as discussed for the FIG. 1 situation. A Darlington P-N type transistor with an N type base Q2 is shown in FIG. 7, and for simplicity in symbolic notation in FIG. 8 with the symbol D therein indicating a Darlington type circuit. Likewise, a unijunction Darlington transistor of the N-P type with a P type base Q3 is shown in FIG. 9 with its symbolic form denoted by symbol D in FIG. 10. Such transistors Q2 and Q3 have their bases B1 series connected, the base B2 of Q2 being connected to DC power source 10, whereas the base B2 of Q3 is connected to primary winding L1 of the ignition transformer. The output winding of the timer is connected to the emitters of Q2 and Q3 providing similar inputs to activate and deactivate Q2 and Q3 as discussed for the FIG. 1 situation.

Referring to FIGS. 12, 13, 14, 15, 16, 17, 18 and 19, which illustrate bipolar switching operation of an ignition system utilizing timer 20 connected to a Darlington pair of N-channel and P-channel transistors and also to a non-Darlington pair of N-channel and P-channel transistors of the field effect types, when such transistor pairs are utilized as ignition electronics activated and deactivated by the bipolar pulse pair respectively produced by timer 20.

Figure 12:
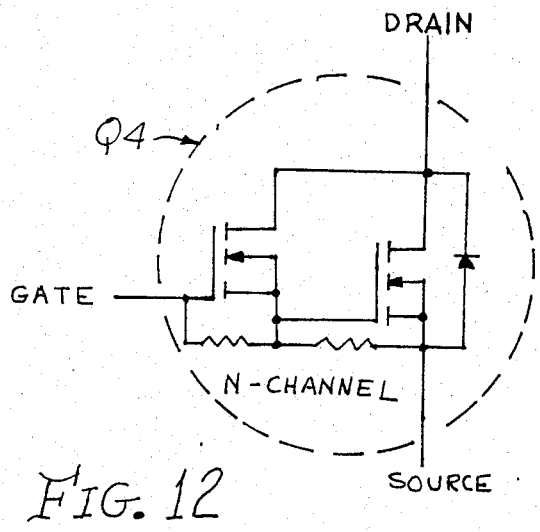
FIGS. 12, 13, 14 and 15 are representative N-channel and P-channel field effect Darlington transistors utilized in the circuit of FIG. 18, which is the analog of FIG. 1 circuit.
Figure 13:
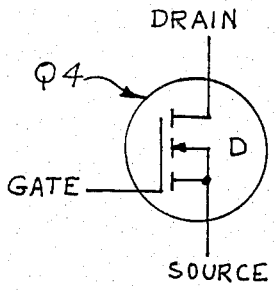
Figure 14:
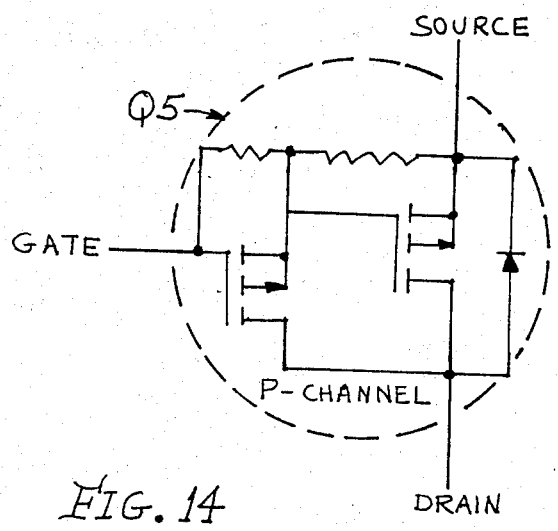
Figure 15:
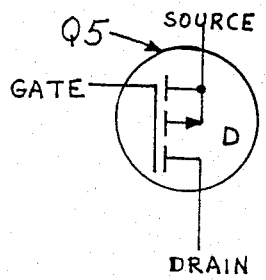
Figure 18:
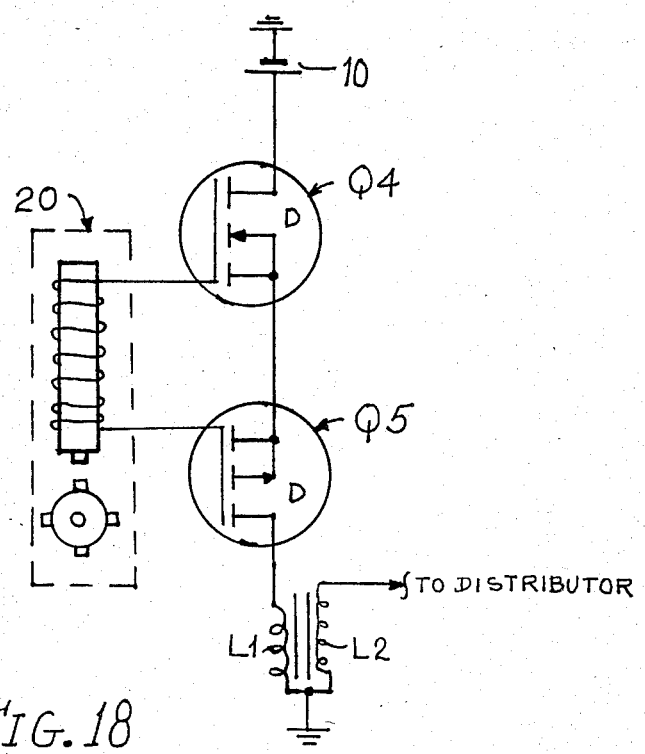

Transistor Q4 of FIG. 12 is symbolically shown as a Darlington type in FIG. 13 illustration wherein the symbol D therein indicates Darlington circuitry. Transistor Q4 is of the N-channel type. Transistors Q5 of FIG. 14 is of the P-channel type and is symbolically shown as a Darlington type in FIG. 15 wherein symbol D identifies Darlington circuitry. FIG. 18 illustrates transistors Q4 and Q5 as providing the total ignition electronics in conjunction with timer 20.

Figure 16:
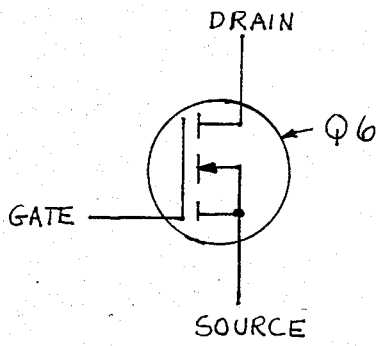
FIGS. 16 and 17 are representative of N-channel and P-channel field effect non-Darlington type transistors utilized in the circuit of FIG. 19, and performing in manner similar to that of FIG. 18 circuit.
Figure 17:
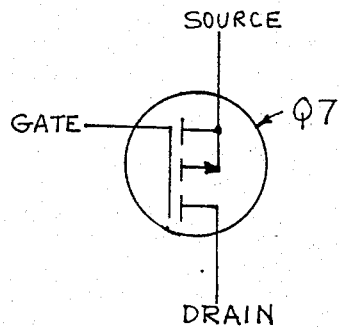
Figure 19:
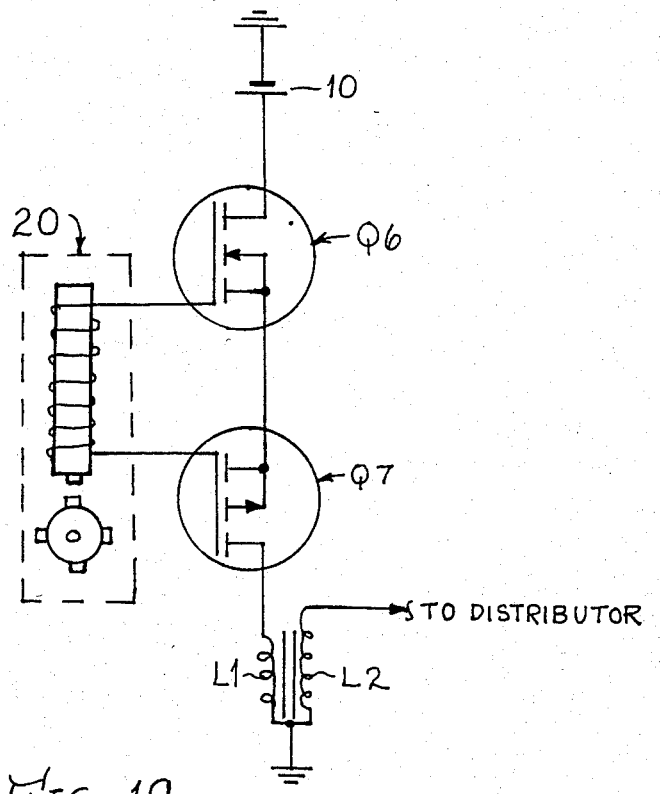

FIGS. 16 and 17 illustrating N-channel and P-channel non-Darlington transistors are also usable as a pair of complementary transistors of opposite conductivities in the circuit of FIG. 19. Hence, in FIG. 18, the gates of transistors Q4 and Q5 are connected to the output winding or coil in timer 20, and in FIG. 19 the gates of transistors Q6 and Q7 are similarly connected. In both FIGS. 18 and 19 the N-channel transistors Q4 and Q6 have their drains connected to the positive terminal of the DC source 10. The drains of P-channel transistors Q5 and Q7 are connected to the primary winding L1 of the ignition transformer. The sources of transistor pair Q4–Q5 are serially interconnected and the sources of transistors Q6–Q7 are also serially interconnected. Otherwise the circuits of FIGS. 18 and 19 both function as described for the circuit of FIG. 1 situation, wherein the gates are analogous to the bases of Qa–Qb, the drains are analogous to the collectors of Qa–Qb, and the sources are analogous to the emitters of Qa–Qb.

I claim:

1. An ignition system for a fuel burning engine, said system having a transformer with a primary winding, characterized by the combination of:

a pair of transistors of opposite conductivities, each of said transistors having an input and an output circuit, the output circuits of said transistors being connected in series, said primary winding being serially coupled to the output circuits of said transistors; and a timer coupled to the input circuits of said transistors.

2. The system as stated in claim 1, wherein said timer is of the magnetic pulse type.

3. The system as stated in claim 1, including:

an alternating current generator connected to said output circuits, said primary winding being an integral part of the generator, said transformer having a secondary winding coupled to the primary winding; and a tertiary winding coupled to the primary winding, said tertiary winding being means for connecting said generator to the output circuits.

4. The system as stated in claim 3, including another pair of transistors coupled to the primary winding and to the tertiary winding.

5. An ignition system for a fuel burning engine, said system having a transformer with a primary winding, characterized by the combination of:

a pair of Darlington type transistors of opposite conductivities, each of said transistors having an input and an output circuit, the output circuits of said transistors being connected in series, said primary winding being serially coupled to the output circuits of said transistors; and a timer coupled to the input circuits of said transistors.

6. The system as stated in claim 5, wherein said timer is of the magnetic pulse type.

7. The system as stated in claim 5, wherein said transistors are of the multijunction type.

8. The system as stated in claim 5, wherein said transistors are of the unijunction type.

9. The system as stated in claim 5, wherein said transistors are of the field effect type.

10. The system as stated in claim 7, wherein said transistors are of the NPN and PNP types with bases to which said timer is connected.

11. The system as stated in claim 8, wherein said transistors are of N-P and P-N types with emitters to which said timer is connected.

12. The system as stated in claim 9, wherein said transistors are of the N-channel and P-channel types with gates to which said timer is connected.

13. An ignition system for a fuel burning engine, said system having a transformer with a primary winding, characterized by the combination of:

a pair of junction type transistors of opposite conductivities, each of said transistors having an input and an output circuit, the output circuits of said transistors being connected in series, said primary winding being serially coupled to the output circiuts of said transistors; and a timer coupled to the input circuits of said transistors.

14. The system as stated in claim 13, wherein said timer is of the magnetic pulse type.

15. The system as stated in claim 13, wherein said transistors are of the multijunction type.

16. The system as stated in claim 13, wherein said transistors are of unijunction type.

17. The system as stated in claim 15, wherein said transistors are of the NPN and PNP types with bases to which said timer is connected.

18. The system as stated in claim 16, wherein said transistors are of the N-P and P-N types with emitters to which said timer is connected.

19. An ignition system for a fuel burning engine, said system having a transformer with a primary winding, characterized by the combination of:

a pair of field effect transistors of opposite conductivities, each of said transistors having an input and an output circuit, the output circuits of said transistors being connected in series, said primary winding being serially coupled to the output circuits of said transistors; and a timer coupled to the input circuits of said transistors.

20. The system as stated in claim 19, wherein said timer is of the magnetic pulse type.

21. The system as stated in claim 19, wherein said transistors are of the N-channel and P-channel types with gates to which said timer is connected.

* * * * *